US005217382A

United States Patent [19]

Sparks

[11] Patent Number: 5,217,382

[45] Date of Patent: Jun. 8, 1993

[54] ELECTRIC RECEPTACLE WITH SHAPE MEMORY SPRING MEMBER

[75] Inventor: Glen E. Sparks, Woodhaven, Mich.

[73] Assignee: Interlock Corporation, Westland, Mich.

[21] Appl. No.: 894,454

[22] Filed: Jun. 5, 1992

[51] Int. Cl.[5] ..... H01R 13/20

[52] U.S. Cl. ..... 439/161; 439/843

[58] Field of Search ..... 439/161, 843, 844, 845, 439/846

[56] References Cited

U.S. PATENT DOCUMENTS 1,437,209 11/1922 Wenderhold ..... 439/161
3,112,146 11/1963 Barnhart ..... 439/161
4,634,201 1/1987 Kemka ..... 439/161
4,880,401 11/1989 Shima et al. ..... 439/843 X

*Primary Examiner*—Larry I. Schwartz
*Assistant Examiner*—Khiem Nguyen
*Attorney, Agent, or Firm*—Harness, Dickey & Pierce

[57] ABSTRACT

A two-piece electrical receptacle terminal for receiving a male terminal. The receptacle terminal includes a spring, having a predetermined shape, which is confined within an integrally formed housing. During insertion of the male terminal into the housing, the spring is deflected from the predetermined shape. The spring is constructed of a metal which exhibits a memory, evoked by heating, predisposing the deflected spring into its predetermined shape. Heating can be accomplished by ohmic self-heating.

19 Claims, 2 Drawing Sheets

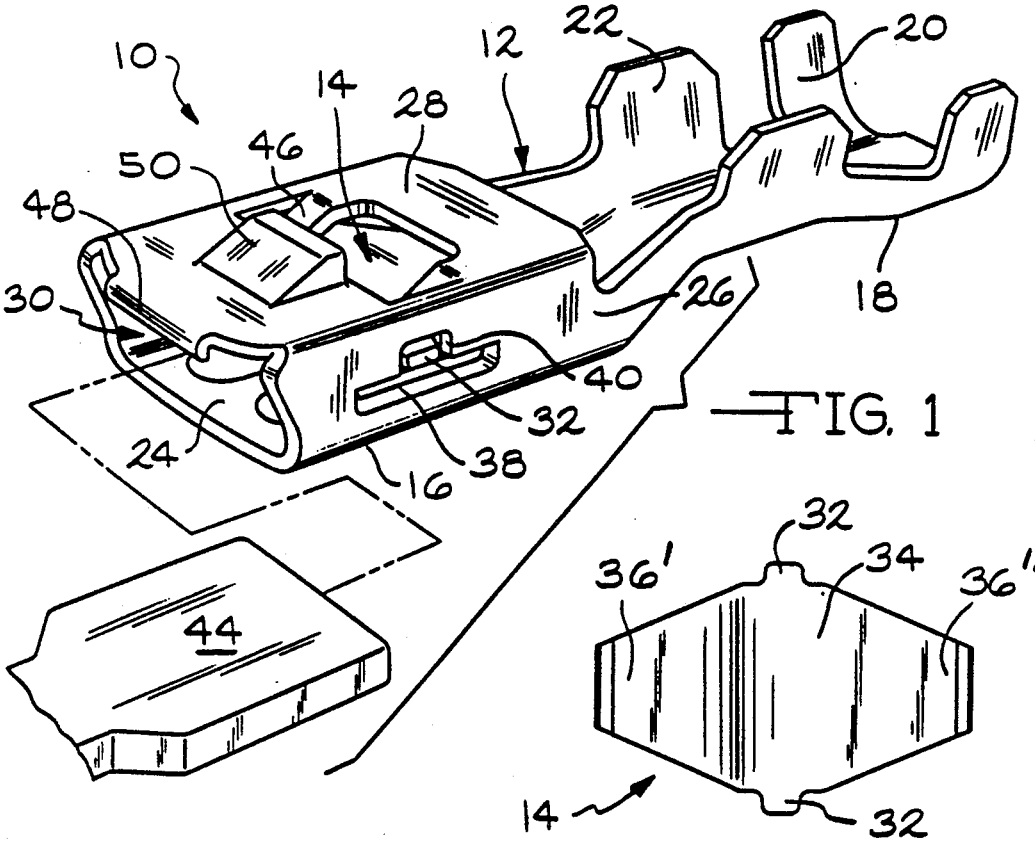
FIG. 1
FIG. 2
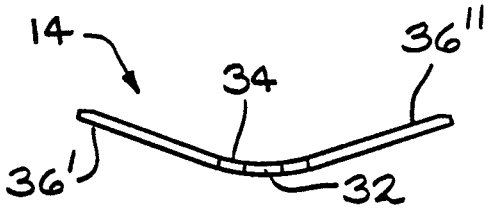
FIG. 3
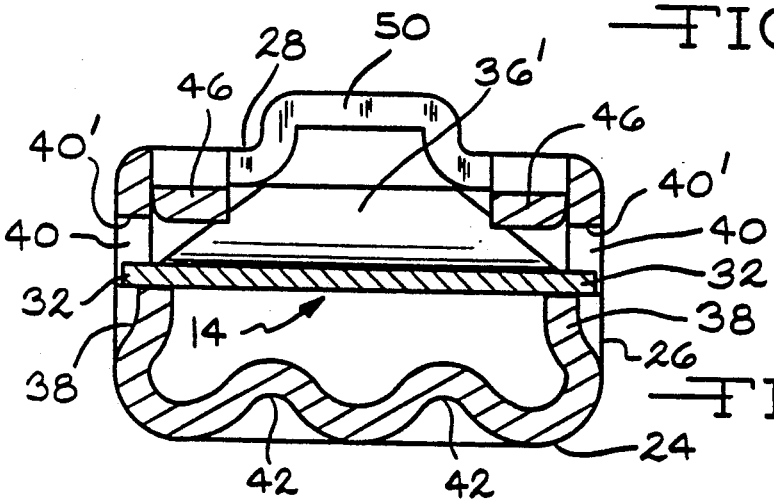
FIG. 6

ELECTRIC RECEPTACLE WITH SHAPE MEMORY SPRING MEMBER

BACKGROUND AND SUMMARY OF THE INVENTION

This invention generally relates to electrical connectors. More particularly, the invention relates to a two-piece, electrical receptacle terminal.

Receptacle terminals exhibiting a two or multiple piece construction are well known. These terminals generally include a housing which forms a box-type receptacle, into which a spring member is mounted. A tab or pin male terminal is inserted into the housing and is biased into contact with the housing thereby ensuring that electrical contact is made and that the male terminal is not inadvertently withdrawn from the receptacle terminal. One such receptacle terminal is disclosed in U.S. Pat. No. 3,370,265.

An early generation of these two-piece terminals were constructed with both the spring member and the housing being formed from the same metal. Typically, this metal was a high conductivity metal such as copper or a copper alloy and may have been plated with tin. While being good conductors of electricity, these metals operated poorly as springs.

The above problem led to the development of a second generation of two-piece receptacle terminals in which the housing or main body was constructed of a metal exhibiting good conductivity characteristics while the spring member was constructed of a second metal having good spring characteristics. An example of a metal used for the spring member because of its high spring rate is beryllium copper. While this second generation of receptacle terminals overcame the problems of the first, either poor spring characteristics or poor conductivity characteristics, the second generation of receptacle terminals is not without limitations.

Regarding these limitations, both generations of two-piece receptacle terminals, and especially those with copper and copper alloy spring members, have exhibited a susceptibility to mechanical over-stressing or over-sizing. Over-sizing of the receptacle is caused by the insertion of a male terminal having a large or "maximum" thickness into the gap defined between the contacts of the housing and the spring member. The insertion of this thick male terminal often results in stressing of the spring member past its plastic deformation point, resulting in a failure of the spring member to fully recover its original shape. Subsequent insertion of a smaller or "minimum" thickness male terminal can then result in a loose or non-interference connection and an open circuit or thermal runaway. Furthermore, use of modular electrical systems often results in a maximum thickness male terminal being inserted into the receptacle terminal first, followed by an insertion of a minimum thickness male terminal.

Another limitation often found in two-piece receptacle terminals is thermal stress relaxation of the spring member, again, particularly with copper alloy spring members. Thermal stress relaxation, which causes a reduction in the spring rate, is gradually onset by heating of the spring member over its lifetime. This heating can be induced by ambient heating, ohmic self-heating, and usually, a combination of both.

With the above limitations in mind, it is an object of the present invention to provide for an improved two-piece receptacle terminal exhibiting a bi-metal construction. In providing the receptacle terminal, it is a further object to limit the receptacle terminal's susceptibility to over-stressing and over-sizing. Additionally, it is an object to provide a receptacle terminal which, over its lifetime, is better able to resist thermal stress relaxation. As such, a feature of the present invention is a spring member which is predisposed to return to its original "unsprung" configuration. This predisposition is evoked by the application of heat to the spring member and is in addition to the normal tendency of the spring to return to its unsprung condition.

In achieving the above objects, the present invention provides for a two-piece quick connect tab receptacle terminal which is principally composed of two elements; a main body and a spring member. The main body is formed from a metal stamping which is subsequently bent or folded into a generally rectangular housing which includes contact points for the electrical circuit. This main body is constructed from a high conductivity metal such as a copper alloy.

The second principal component of the present invention is a spring which is retained within the main body. Upon insertion of a male tab terminal, the spring biases the male terminal into contact with the electrical contact points of the main body. The spring is constructed from a second metal and, in particular, a shape memory alloy. The shape memory alloy exhibits the characteristic of being predisposed to return to its original, unsprung shape (or near original shape) during heating. Heating can be accomplished by either ambient heating, applied external heating, ohmic self-heating or a combination of these. As a result of the "memory" of the spring utilized in the present invention, the present invention is not susceptible to thermal stress relaxation; is capable of recovering from over-stressing or over-sizing; and applies an increased biasing force against the male terminal during use.

Additional benefits and advantages of the present invention will become apparent to those skilled in the art to which this invention relates from the subsequent description of the preferred embodiments and the appended claims taken in conjunction with the accompanying drawings.

BRIEF DESCRIPTION OF THE DRAWINGS

FIG. 1 is a perspective view of a receptacle terminal incorporating the principles of the present invention;

FIG. 2 is a plan view of a spring member as utilized in the present invention;

FIG. 3 is a side elevational view of the spring member utilized in the present invention;

FIG. 6 is a sectional view taken substantially along line 6—6 in FIG. 4 of the receptacle terminal embodying the principles of the present invention.

DETAILED DESCRIPTION OF THE PREFERRED EMBODIMENT

Figure 4:
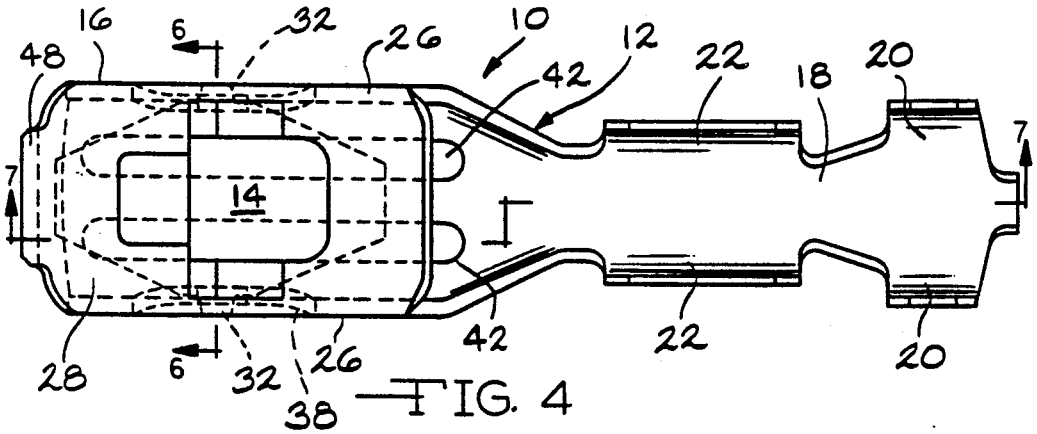
FIG. 4 is a plan view of a receptacle terminal according to the principles of the present invention.
Figure 5:
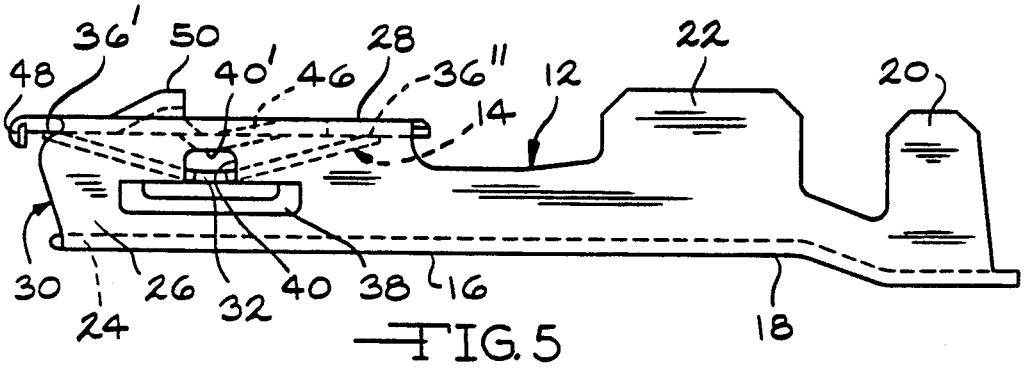
FIG. 5 is a side elevational view of a receptacle terminal according to this invention.
Figure 7:
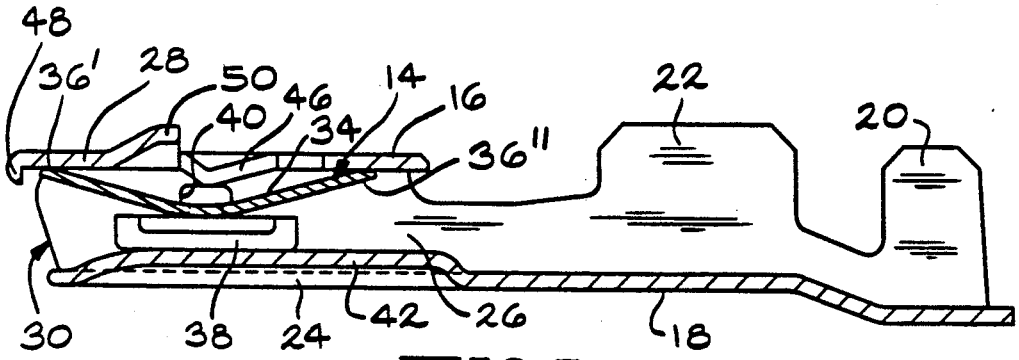
FIG. 7 is a longitudinal sectional view taken substantially along line 7—7 in FIG. 4 showing the spring member positioned within the housing of the present invention.

Now with reference to the drawing, a electrical receptacle terminal embodying the principles of the present invention is illustrated in FIG. 1 and generally designated at 10. The receptacle terminal 10 is further comprised of a main body 12 and a spring 14.

While a specific embodiment is disclosed, it will be appreciated by those skilled in the art that numerous alternative configurations for the spring 14 and the main body 12 could be utilized with the underlying principles of this invention.

The main body 12 is integrally formed from a metal stamping and includes an elongated socket or housing 16 at one end and a ferrule 18 at the other end. The ferrule 18 allows a wire lead (not shown) to be attached to the main body 12 and includes a pair of securement tabs 20, which are folded about the wire lead so as to grip the surrounding insulation, and a pair of contact tabs 22, which are folded onto the stripped wire of the lead ensuring that electrical contact is made between the receptacle terminal 10 and the lead.

The housing 16 is formed by bending tabs of the stamping to define a substantially rectangular box having a base wall 24, side walls 26, and a top wall 28, all of which cooperate to define a receiving cavity 30. The spring 14 itself is confined within the receiving cavity 30 by means which are further described below. The main body 12 is formed from a high conductivity metal such as copper or a copper alloy, including brass, and may be plated with tin or another metal.

As best seen in FIGS. 2 and 3, the spring 14 is a leaf spring and exhibits a generally bowed shape. When viewed from above, the spring 14 has a modified cross shape with a pair of ears 32 extending laterally from a center portion 34 thereof. Being widest at its center 34, where the ears 32 project outwardly, the spring 14 decreasingly tapers toward each of its ends 36' and 36".

The spring 14 is formed from a shape memory alloy (hereinafter SMA). By way of illustration and not limitation, SMAs that can be used to construct the spring 14 include silver-cadmium (AgCd), gold-cadmium (AuCd), copper-aluminum-nickel (CuAlNi), copper-tin (CuSn), copper-zinc (CuZn), alloys of copper-zinc (CuZn-X), indium-titanium (InTi), nickel-aluminum (NiAl), nickel-titanium (NiTi), iron-platinum (FePt), manganese-copper (MnCu) and iron-manganese-silicone (SeMnSi). While any of the above SMAs may be used to construct the spring 14 of the receptacle terminal 10 disclosed herein, nickel-titanium is preferred because of its ready availability and low relative cost. When used for the spring 14 of the present invention, each SMA exhibits thermoelastic martensitic transformation, which is the restoring of the original spring's 14 unsprung shape, or near original shape, during heating of the receptacle terminal 10. The benefits of the above are more fully set out below.

To retain the spring 14 within the housing 16, a step shoulder 38 and window 40 are formed in each side wall. The step shoulders 38 are formed from portions of the side walls 26 being deformed into the cavity 30 of the housing 16 and operate to provide a reaction surface for the ears 32 of the spring 14.

Vertically adjacent to the step shoulders 38 and also formed in the side walls 26 are the windows 40. Each window 40 is completely defined within its respective side wall 26. During initial formation of the receptacle 10, the side walls 26 are partially bent upwards from the base wall 24 and the spring 14 is positioned so that the ears 32 rest upon the step shoulders 38 generally aligned to extend into the windows 40. As the side walls 26 are further bent into their final configuration, generally perpendicular to the base wall 24, the ears 32 of the spring 14 become "captured" within the openings of the windows 40. The axial width of the windows 40 prevent any significant amount of axial movement of the spring within the receiving cavity 30 of the housing 16. The height of the windows 40 ensures that the spring 14 can be adequately deflected during insertion of a male terminal 44. When confined within the housing 16, the ends 36 of the spring 14 are urged by the spring's 14 bowed shape into contact with the top wall 28. The top wall 28 is generally parallel with the base wall 24 and is bent approximately ninety degrees (90°) relative to the side walls 26.

Contact ridges 42 are formed in the base wall 24 of the housing 16 and extend axially therealong. During insertion of the male terminal 44 into the receiving cavity 30, the male terminal 44 engages the spring 14 so as to be biased against the contact ridges. The male terminal 44 then slides along the contact ridges 42 until it is fully inserted into the receptacle terminal 10. If the thickness of the male terminal 44 is great enough, that is, if the thickness of the male terminal 44 exceeds the maximum tolerance limitations for the receptacle terminal 10, the spring 14 may be deflected upward an amount which will cause the ears 32 to engage the upper limit 40' of the windows 40. Since occurrences of the above are not infrequent, several features, in addition to the upper limit 40' of the windows 40, are incorporated into the receptacle terminal 10 to prevent excessive deflection of the spring 14. These features include a deflection limiting shoulder 46 and a stop lip 48. The deflection limiting shoulder 46 is formed in the top wall 28 and extends downwardly and inwardly of the receiving cavity 30. The downward extent of the deflection limiting shoulder 46 corresponds with the upper limit 40' of the windows 40. In this manner, the ears 32 of the spring 14 and the deflection limiting shoulder 46 will respectively prevent the lateral portions and the center 34 of the spring 14 from being over deflected by a male terminal 44 having a "maximum" or excessive thickness.

The stop lip 48 is a downwardly turned or return bent portion of the top wall 28 located at the insertion end of the receiving cavity 30. As the spring 14 is deflected, the ends 36' and 36" will slide axially along the top wall 28 so that the outboard end 36' of the spring 14 will engage the stop lip 48. Further excessive deflection is prevented by the ears 32 engaging the inboard marginal edge of the windows 40, the edge away from the stop lip 48, as the inboard end 36' of the spring 14 slides along the top 28 in response to the engagement of its outboard end 36' with the stop lip 48. The stop lip 48 further acts as a guide which directs the male terminal 44 into the receiving cavity 30 of the housing 16 and prevents the male terminal 44 from engaging and possibly damaging the outboard end 36' of the spring 14.

An outwardly extending shoulder 50 is shown formed in the top wall 28 of the housing 16. If the receptacle terminal 10 is to be used in conjunction with a plastic electrical connector (not shown), the electrical connector may be provided with a resilient finger to engage the shoulder 50 and prevent inadvertent withdrawal of the receptacle terminal 10 from the electrical connector.

While numerous features are provided in the receptacle terminal 10 to prevent over deflection of the spring 14, the most important attribute for preventing over deflection is the spring 14 (hereinafter SMA spring 14)

itself. Since the SMA spring 14 exhibits thermoelastic martensitic transformation, the SMA spring 14 is initially formed so that its memory, which will be evoked by heating, induces it to return to its original bowed or unsprung shape. Heating of the SMA spring 14 can be accomplished by the means discussed above, however, it is believed that ohmic self-heating (heating caused by the conduction of electricity through the terminals) will prove most beneficial. During heating, the memory of the SMA spring 14 urges the spring 14 back into its original shape. This urging further increases the spring force being applied to the male terminal 44 and further insuring engagement with the contact ridges 42. Because the SMA spring 14 becomes activated under heat and actually exerts a higher spring force than in the absence of heat, it can be seen that the SMA spring 14 will not be susceptible to thermal stress relaxation which tends to reduce spring forces over the life of the spring.

The SMA spring 14 is also beneficial if over-sizing or over-stressing does occur. If over-sizing should occur from the insertion of a male terminal 44 having a excessive thickness, upon the ohmic self-heating of the SMA spring 14, the SMA spring 14 will exhibit a "self-healing" characteristic and compensate for any otherwise "permanent" deformation which would have occurred with any other spring alloy. Because of this, subsequent use with a normal thickness male terminals 44 will not be compromised.

While the above description constitutes the preferred embodiments of the present invention, it will be appreciated that the invention is susceptible to modification, variation and change without departing from the proper scope and fair meaning of the accompanying claims.

What is claimed is:

1. A receptacle electrical terminal for receiving a male electrical terminal comprising:

an integrally formed main body constructed of a first metal, said main body including a housing and means for securing an electrical lead thereto, said housing having walls cooperating to define a receiving cavity therein and an insertion opening at one end permitting insertion of said male electrical terminal into said receiving cavity; and a biasing member located in said receiving cavity and constructed of a second metal, said biasing member having a predetermined shape and being deformable from said predetermined shape in response to insertion of said male electrical terminal into said receiving cavity, said biasing member exerting a biasing force which urges said male electrical terminal into electrical and frictional contact with said housing when deformed by insertion of said male electrical terminal into said receiving cavity, said biasing member also having a shape memory evoked by heating, said shape memory causing said biasing member to return to said predetermined shape during heating thereof and to exert a greater biasing force which further urges said male electrical terminal into electrical and frictional contact with said housing.

2. An apparatus as set forth in claim 1 wherein said second metal exhibits thermoelastic martensitic transformation.

3. An apparatus as set forth in claim 1 wherein said second metal is a shape memory alloy.

4. An apparatus as set forth in claim 1 wherein said second metal is a nickel-titanium alloy.

5. An apparatus as set forth in claim 1 wherein said second metal is an alloy selected from the group including silver-cadmium, gold-cadmium, copper-aluminum-nickel, copper-tin, copper-zinc, indium-titanium, nickel-aluminum, nickel-titanium, iron-platinum, manganese-copper, and iron-manganese-silicon.

6. An apparatus as set forth in claim 1 wherein said second metal is an alloy exhibiting thermoelastic martensitic transformation.

7. An apparatus as set forth in claim 1 wherein said heating is by ambient heating.

8. An apparatus as set forth in claim 1 wherein said heating is by ohmic self-heating.

9. An apparatus as set forth in claim 1 wherein said housing is integrally formed and includes a base wall, side walls and a top wall.

10. An apparatus as set forth in claim 9 wherein said housing includes means for retaining said biasing member therein.

11. An apparatus as set forth in claim 10 wherein said means for retaining said biasing member is formed in said side walls.

12. An apparatus as set forth in claim 11 wherein said means for retaining said biasing member includes portions defining an opening in said side walls, said opening being completely defined in said side walls.

13. An apparatus as set forth in claim 12 wherein said biasing member includes laterally extending tabs.

14. An apparatus as set forth in claim 13 wherein said tabs extend into said openings.

15. An apparatus as set forth in claim 13 wherein said tabs are substantially centrally formed on said biasing member.

16. An apparatus as set forth in claim 13 wherein said main body is formed of an integral stamping being bent to form said housing.

17. An apparatus as set forth in claim 16 wherein said openings are positioned in said side walls to encapture said tabs therein and retain said biasing means as said stamping is bent.

18. An apparatus as set forth in claim 1 wherein said biasing member is a spring.

19. An apparatus as set forth in claim 1 wherein said biasing member is a leaf spring.

* * * * *